US005813383A

United States Patent [19]

Cummings

[11] Patent Number: 5,813,383

[45] Date of Patent: Sep. 29, 1998

[54] VARIABLE DISPLACEMENT DIESEL ENGINE

[76] Inventor: Henry W. Cummings, 3313 W. Adams St., St. Charles, Mo. 63301

[21] Appl. No.: 706,998

[22] Filed: Sep. 4, 1996

[51] Int. Cl.[6] ..... F02B 77/00

[52] U.S. Cl. ..... 123/198 F; 123/145 A

[58] Field of Search ..... 123/481, 498 F, 123/145 A

[56] References Cited

U.S. PATENT DOCUMENTS 4,483,284 11/1984 Andreasson ..... 123/145 A 4,640,241 2/1987 Matsunaga ..... 123/198 F 4,733,053 3/1988 Mueller ..... 123/145 A

*Primary Examiner*—Noah P. Kamen

*Attorney, Agent, or Firm*—Henry W. Cummings

[57] ABSTRACT

A diesel engine operated with cylinder cut-out is disclosed. The number of operative cylinders is proportional to the load on the engine. A computer stops the flow of fuel to the deactivated cylinders. The computer energizes the glow plugs of the deactived cylinders if the deactivated cylinder temperatures are below a predetermined minimum temperature before reactivating the cylinder.

29 Claims, 13 Drawing Sheets

VARIABLE DISPLACEMENT DIESEL ENGINE

FIELD OF THE INVENTION

This invention relates to internal combustion engines in general, and in particular to diesel engines for industrial applications such as heating, air conditioning, manufacturing equipment, electricity, marine, and automotive.

BACKGROUND OF THE INVENTION

The Diesel engine, invented and perfected by Rudolfph Diesel in the 1890s, is used extensively for a wide variety of applications, including ships, overland trucks, heating and air conditioning, and automotive. The size of the engine varies widely depending on the load.

In 1981 the Cadillac Division of General Motors marketed a variable displacement gasoline engine for automotive use. The 6.0 liter engine would switch from eight to four or six cylinders depending on the load perceived by a computer. When the engine operated in the four or six cylinder mode, fuel was not introduced into the remaining cylinders, so that a saving in fuel was achieved when the engine was operated in the four or six cylinder mode, as compared to fuel consumption in the eight cylinder mode. However, the eight cylinder mode provided the advantage of a powerful full 6.0 liter displacement engine when driving conditions required significant power, such as steep hills, or rapid accelaration. Both full size rear wheel seven passenger, stretch limozines, and smaller front wheel drive models utlilized the 4-6-8 engine.

However, the concept was not offered after 1981, and there were class action law suits alleging that the concept was technically unsound, and/or had not been sufficiently developed to be introduced into the auto market commercially. However, the Inventor's 1981 4-6-8 works fine.

Many Diesel engines must operate on widely varying load conditions. For example, a Diesel locomotive and a Diesel overland truck experience much greater loads going up hill in the Rocky Mountains than going down such mounatains, or over flat farmland of much of the midwest.

Marine Diesels require much less power going down river than up river.

Industrial Diesel engines that provide power for air conditioning and/or heating systems experience lower loads in evenings and on weekends, when only a fraction of full power is required.

Many other examples of the load variations Diesel engines experience will be apparent to those skilled in Diesel engine art.

SUMMARY OF THE INVENTION

A. OBJECTS OF THE INVENTION

One object of the present invention is to reduce the operating cost of diesel engines when operating on light and intermediate load conditions.

Another object is to reduce maintenance costs by varying the cylinders used under low and intermediate load conditions.

Another object is to have available high power when unexpected heavy load conditions arise.

Other objects will be apparent from the following SUMMARY, DESCRIPTION OF PREFERRED EMBODIMENTS, DRAWINGS and CLAIMS.

B. SUMMARY

In accordance with the present invention the variable displacement concept of the 1981 automobile gasoline engine is utilized to reduce Diesel fuel costs when the Diesel engines are operating on light and intermediate loads. Keeping Diesel engines running on all cylinders, on light or intermediate load, for many automotive, locomotive, marine and industrial applications is fuel inefficient, causes unnecessary wear of engine parts, and/or is expensive.

In accordance with the invention, the number of operative cylinders of Diesel engines is reduced under low load, and/or intermediate load operating conditions by not providing fuel to selected cylinders, under light and/or intermediate load conditions, and then under heavy load conditions, more cylinders, or all cylinders are activated and provided with fuel for combustion.

In accordance with another embodiment of the present invention, prior to restoring fuel to inactive cylinders if the inactive cylinders have become below minimum operating temperature, the respective glow plugs of the previously inactive cylinders are activated to heat up the cylinders prior to re-introducing fuel.

In accordance with another embodiment of the invention the shut down of selected cylinders under light load and reactivation under heavy load is computer controlled including control of reactivation of the respective glow plugs prior to reintroduction of fuel into the previously deactivated cylinders to insure that the previously inactive cylinders are sufficiently warm for the combustion process.

In accordance with another embodiment of the invention, the computer controls selection of cylinders to be operated at low and intermediate load, to alternate and/or switch operative cylinders, so that cylinder, piston, plug, valve and other parts wear is generally even, whereby cylinder repair is reduced and maintenance cost is reduced.

In accordance with another embodiment of the present invention, the computer controls cylinder selection during low and intermediate load conditions to select cylinders to be operated whereby the temperature of the inactive cylinders is prevented from becoming sufficiently cool to cause significant stress between cylinders due to contraction and/or expansion of cylinder, piston, plug or other parts in the engine.

In accordance with another embodiment of the invention, in applications where it is not possible to vary the specific cylinders to not be given fuel, the computer reactivates some additional, or all additional cylinders if the temperature of one or more inactive cylinders, or other parts of the engine become sufficiently cool to cause significant stress between cylinders or between other engine parts due to contraction and/or expansion of engine parts.

THE DRAWINGS

Figure 3A:
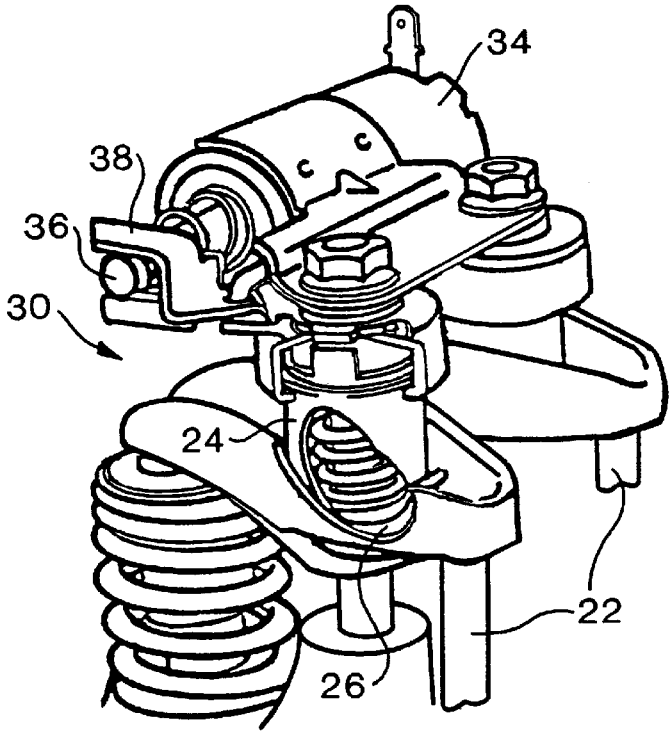
Figure 3B:
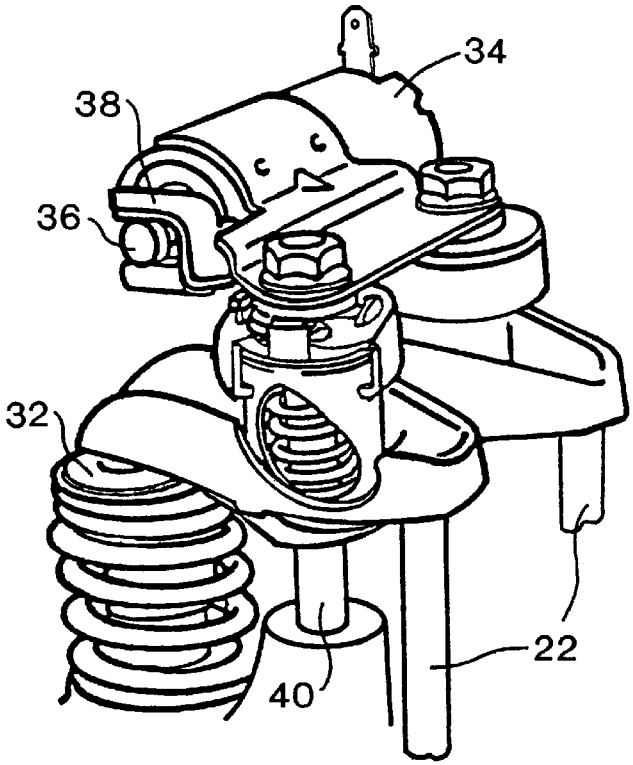

FIG. 3 comprises FIGS. 3A and 3B.

FIG. 3A is a schamatic perspective view of the valve selector assembly with the cylinder in operative posiion.

FIG. 3B is a schamatic perspecive view of the valve selector assembly in the blocking position with the cylinder in inoperative.

Figure 4:
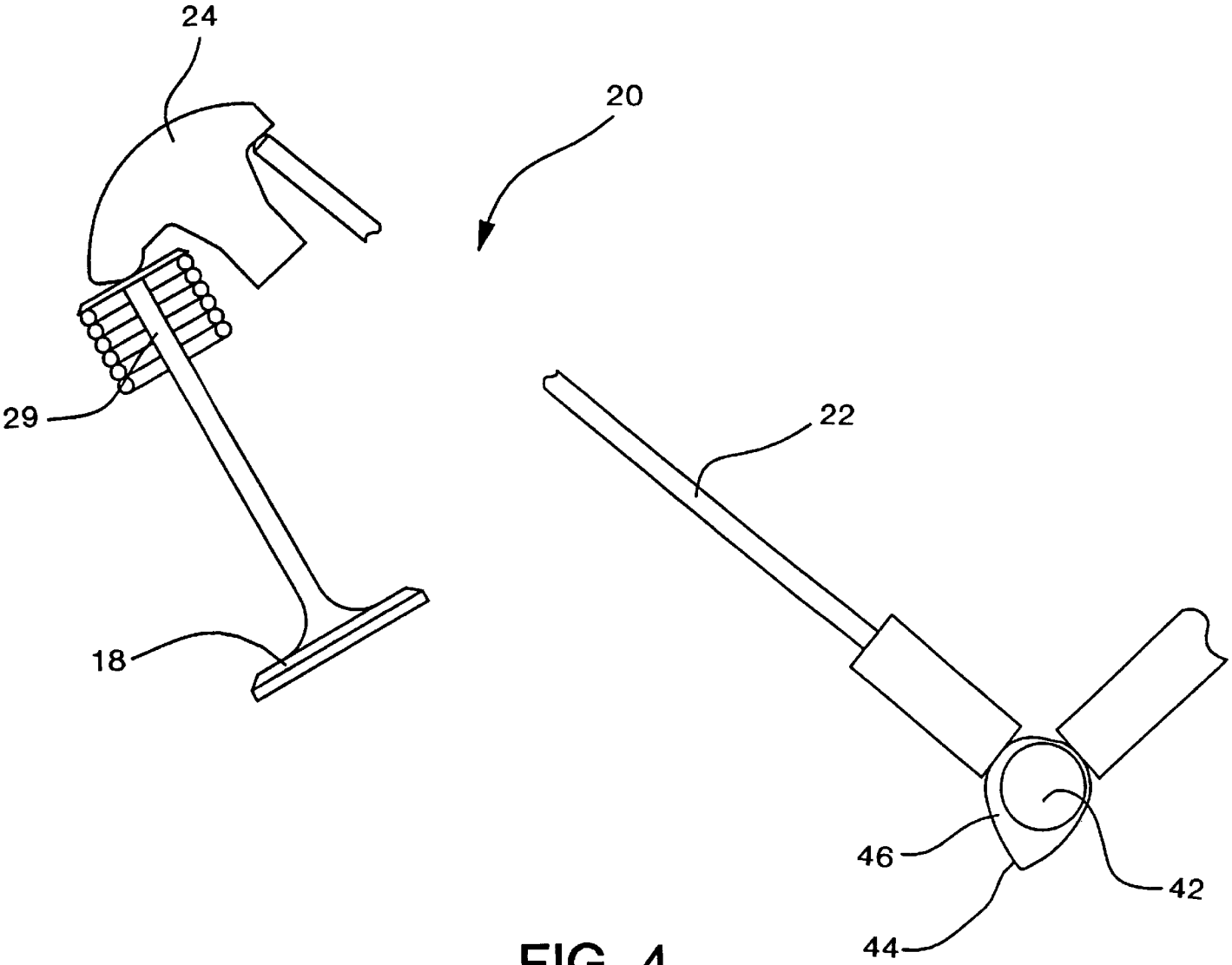

FIG. 4 is a schematic side elevaion view of a cam shaft, cam, push rod, rocker arm and valve which may be used in the present invention.

Figure 5:
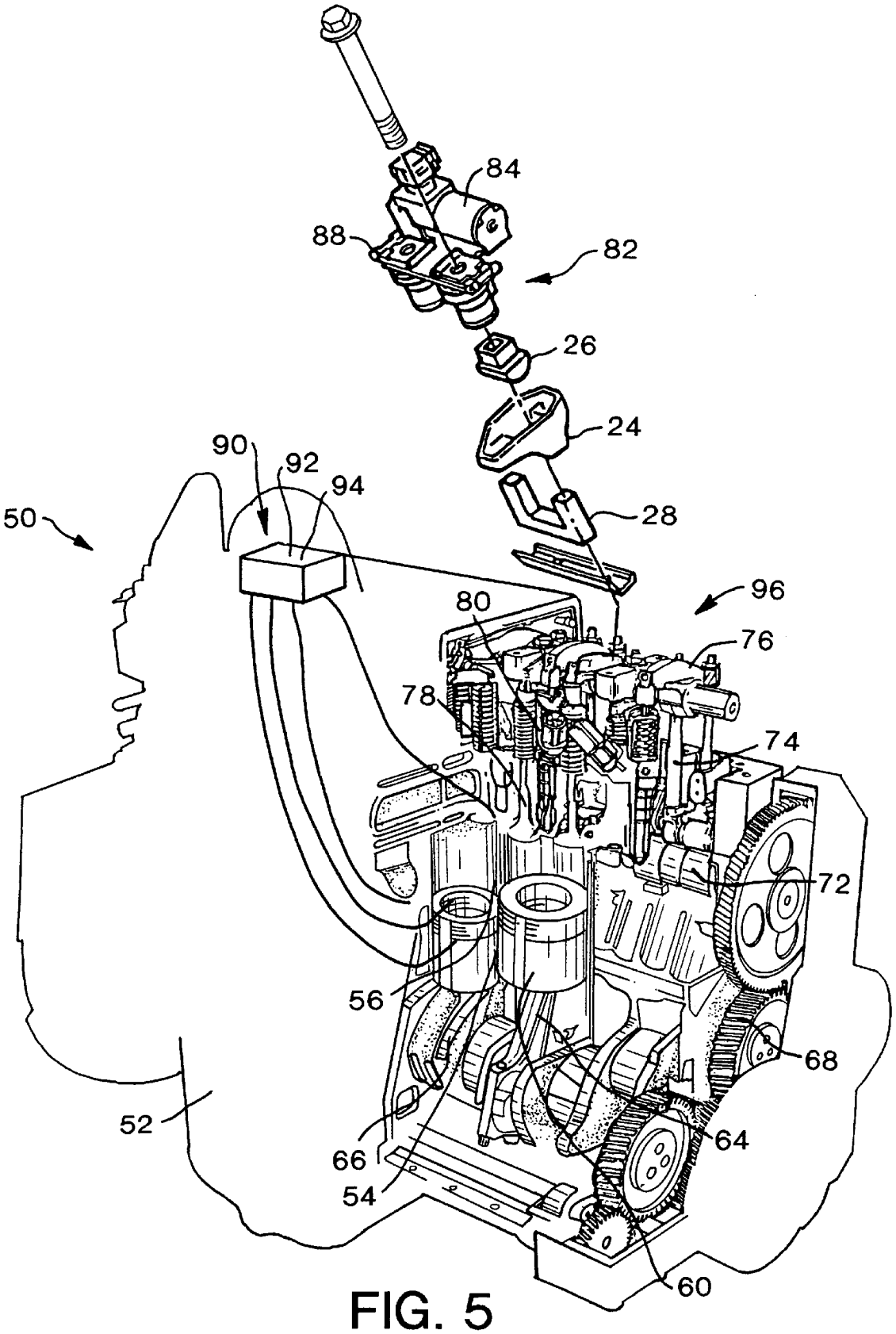

FIG. 5 is a schematic perspective view of an in-line Diesel engine which may be utilized in the present invention.

Figure 6:
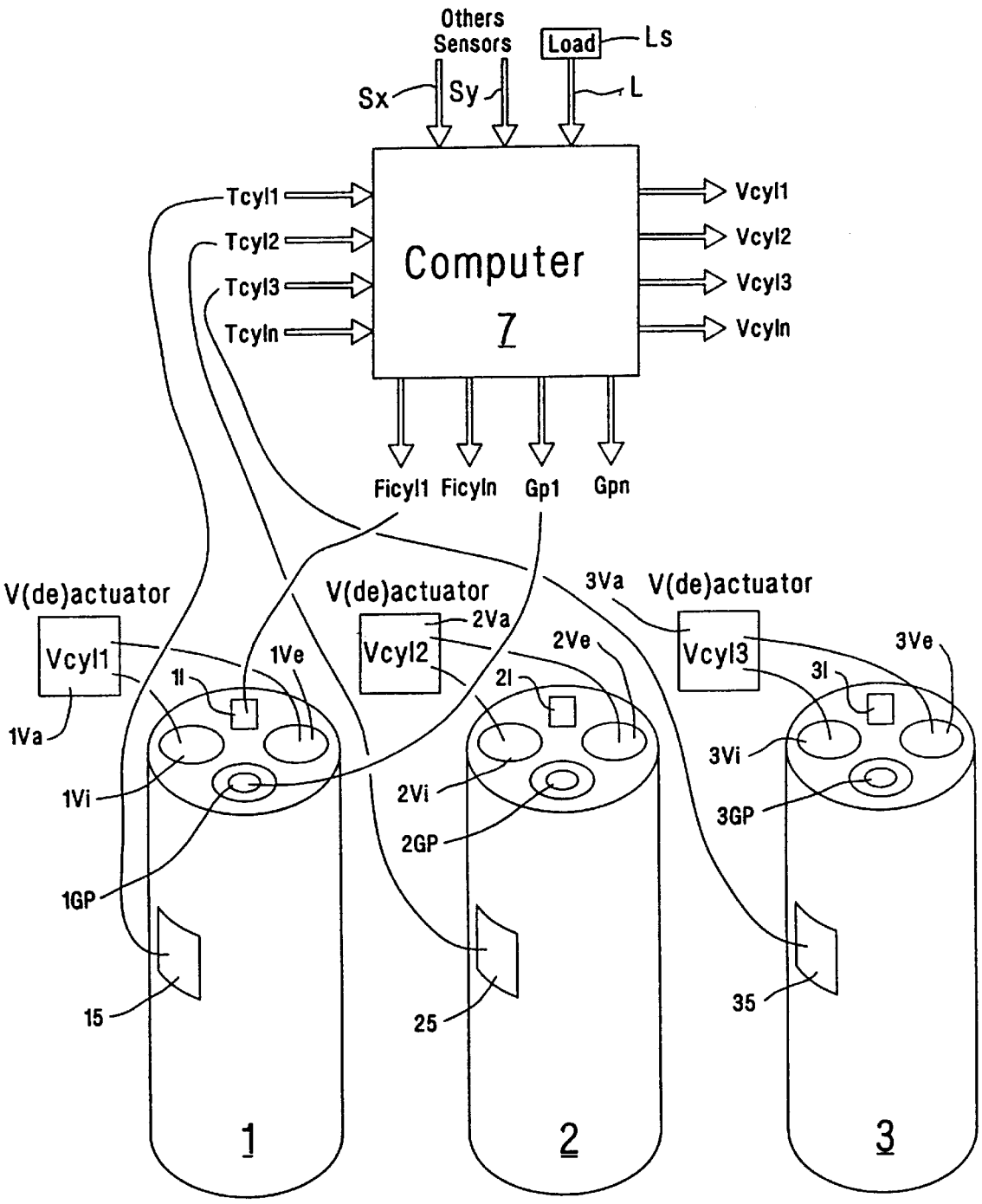

FIG. 6 is a schematic illustration of a Computer Controlled Variable Displacement Diesel engine with cylinders, glow plugs and cylinder temperature sensors for each cylinder being controlled by the computer.

Figure 7:
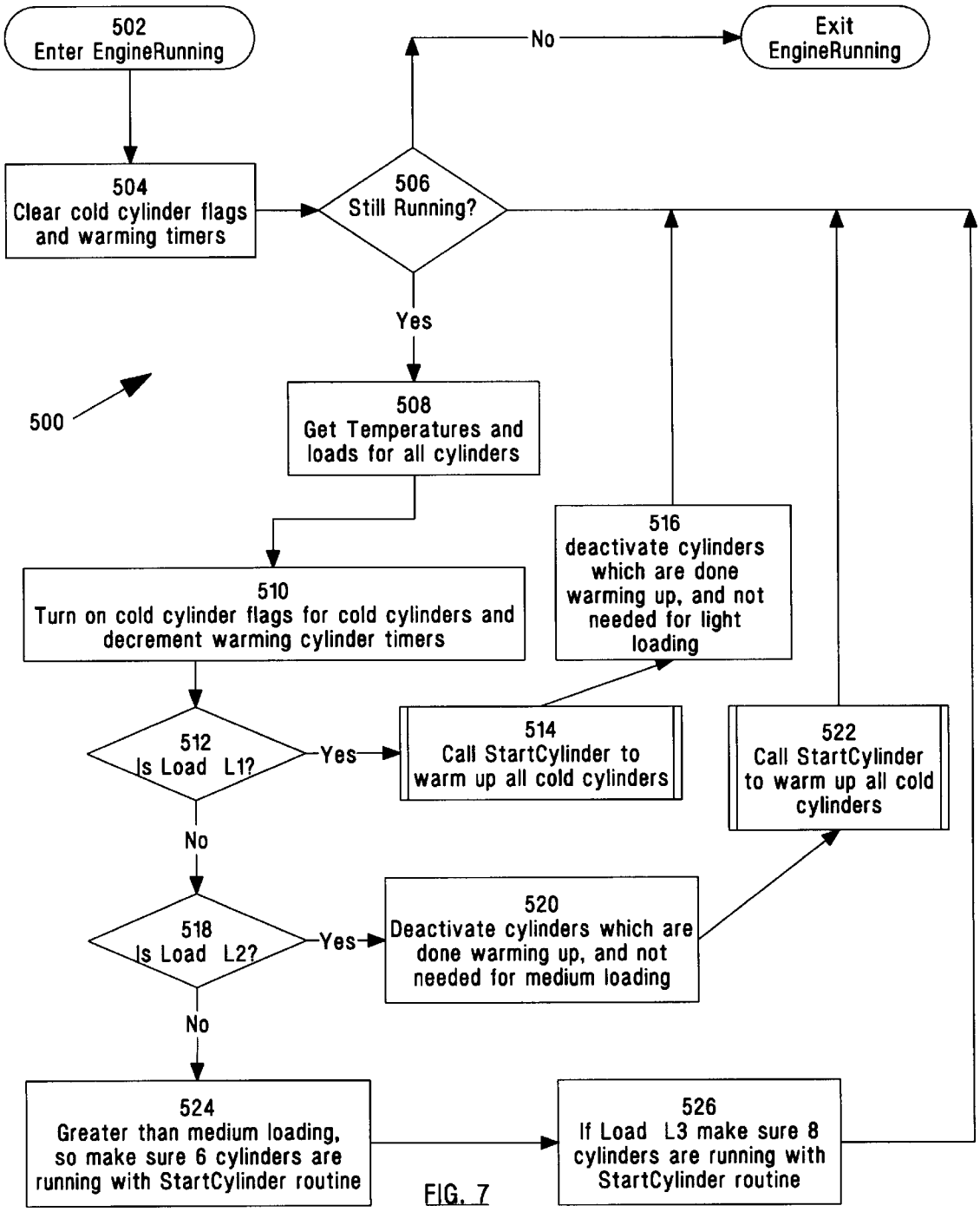

FIG. 7 is a schematic illustration of a Flow chart of the computer control utilized in the present invention including computer controlled glow plug and cylinder activation and deactivation sequence of the present invention.

Figure 8:
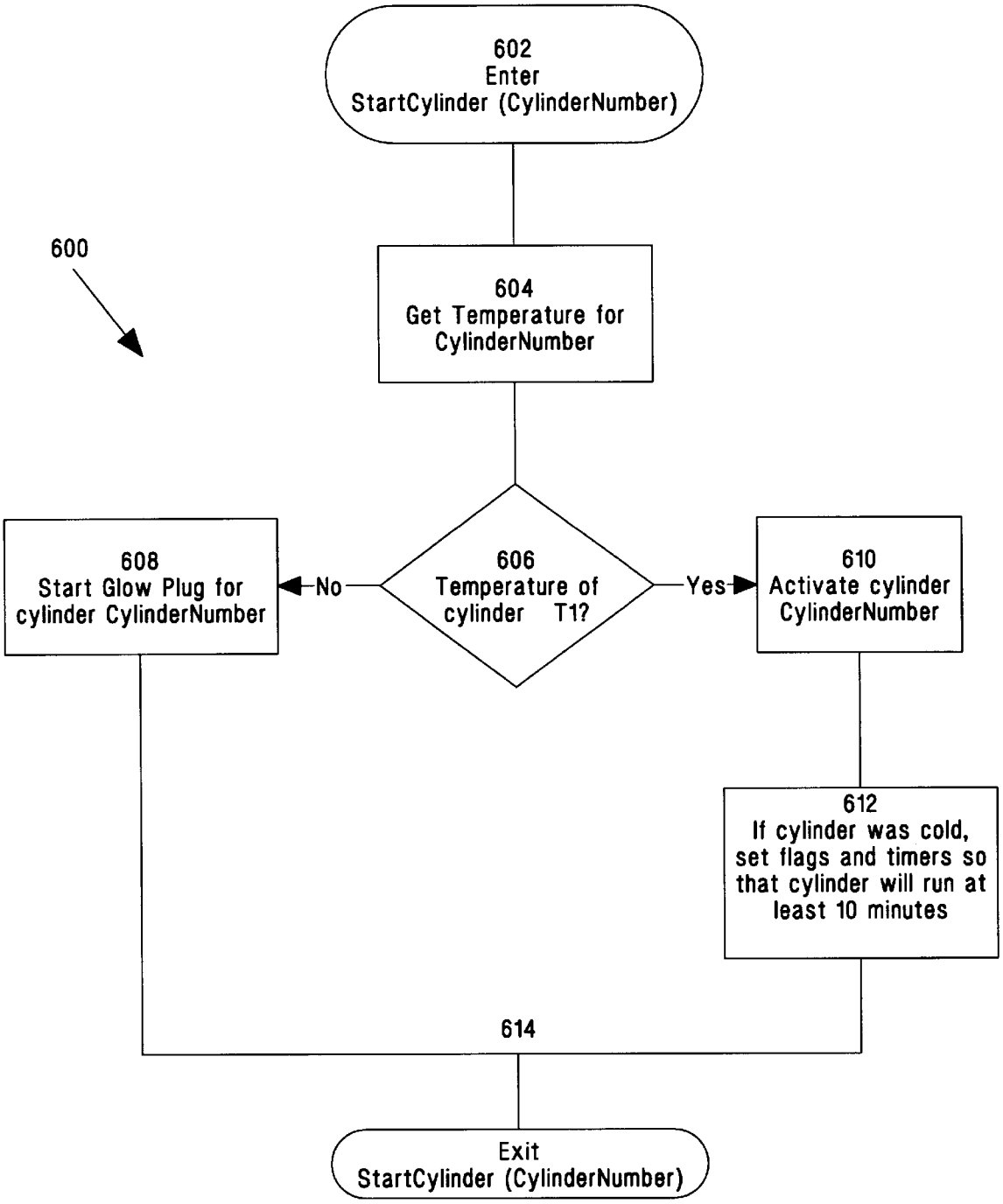

FIG. 8 is a flow chart of a computer controlled glow plug and cylinder activation sequence for individual cylinders.

Figure 9:
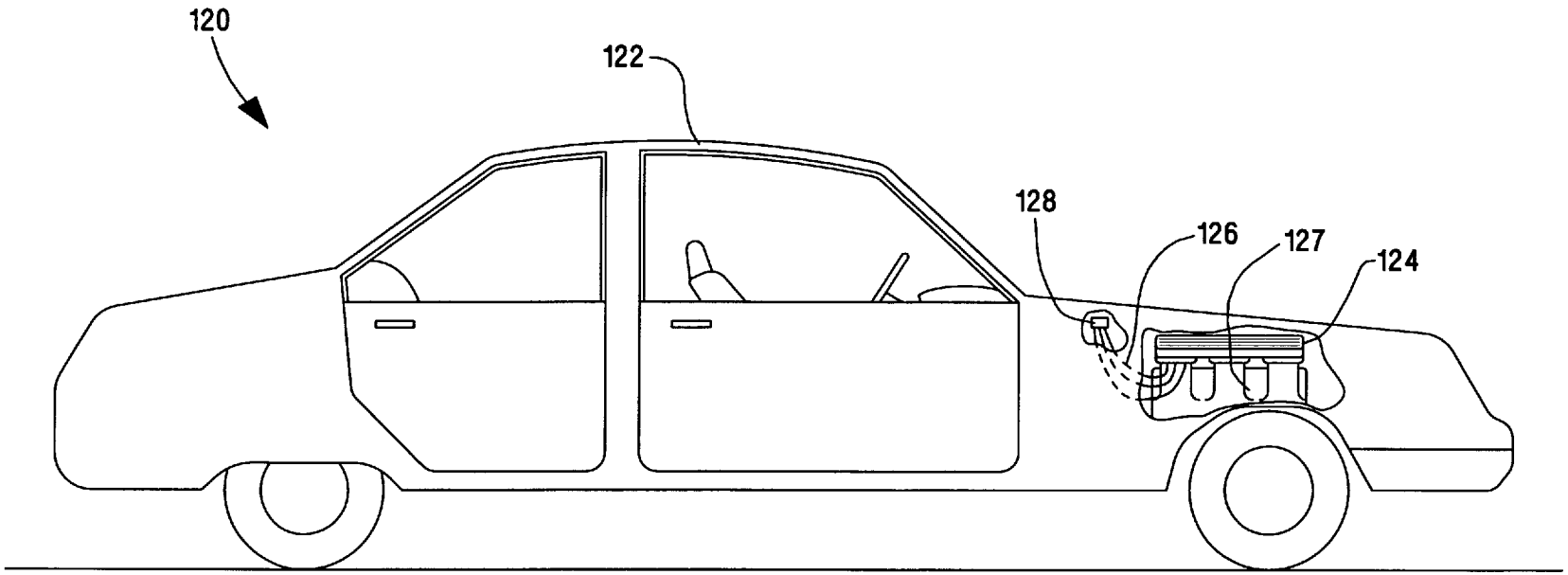

FIG. 9 is an illustration of an automobile powered by the variable displacement Diesel engine of the invention.

Figure 10A:
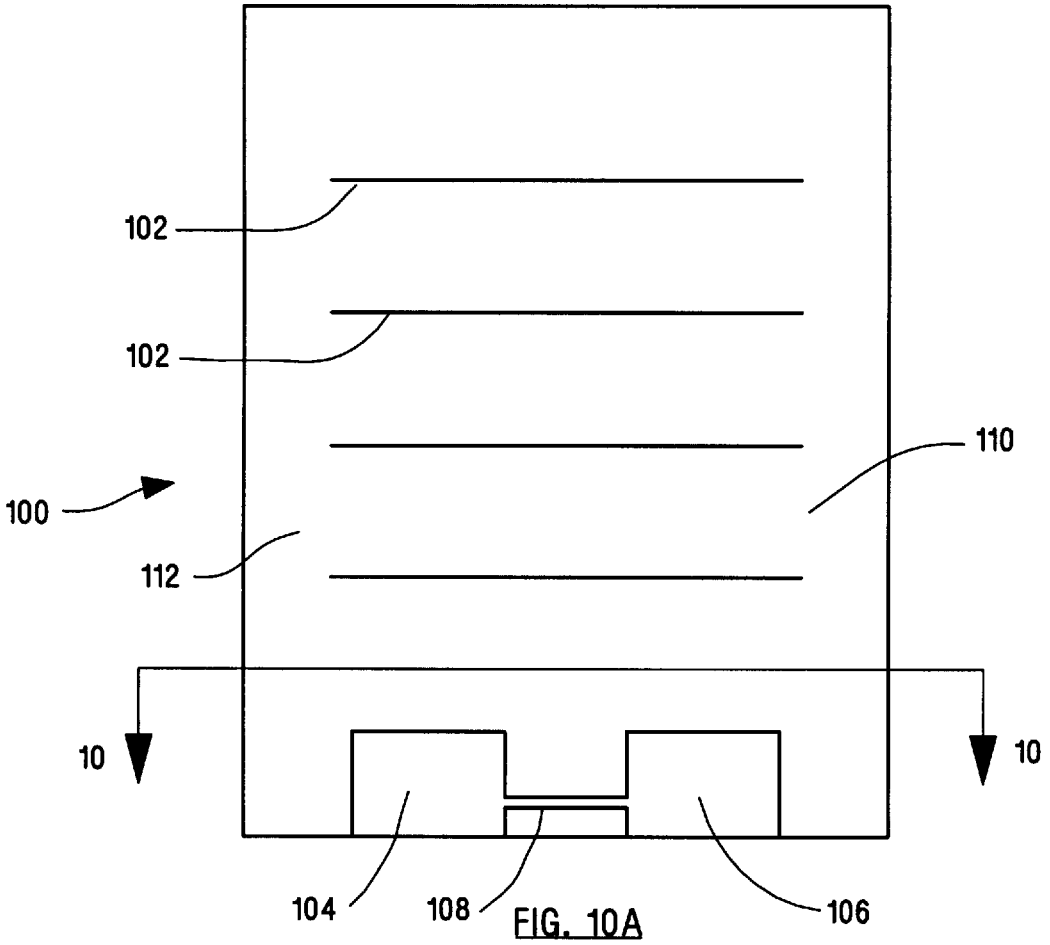

FIG. 10A is a vertical schematic illustration of an office building which is heated and cooled by the Variable Displacement Diesel Engine of the invention.

Figure 10:
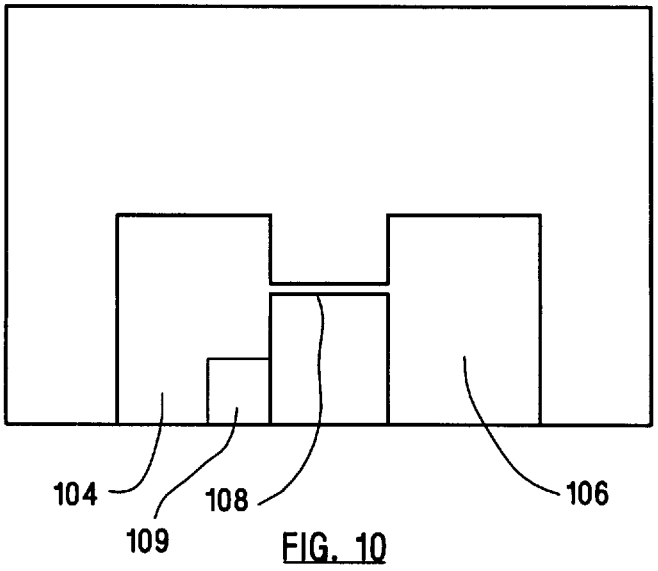

FIG. 10 is a view looking in the direction of the arrows along the line 10—10 in FIG. 10A.

Figure 10B:
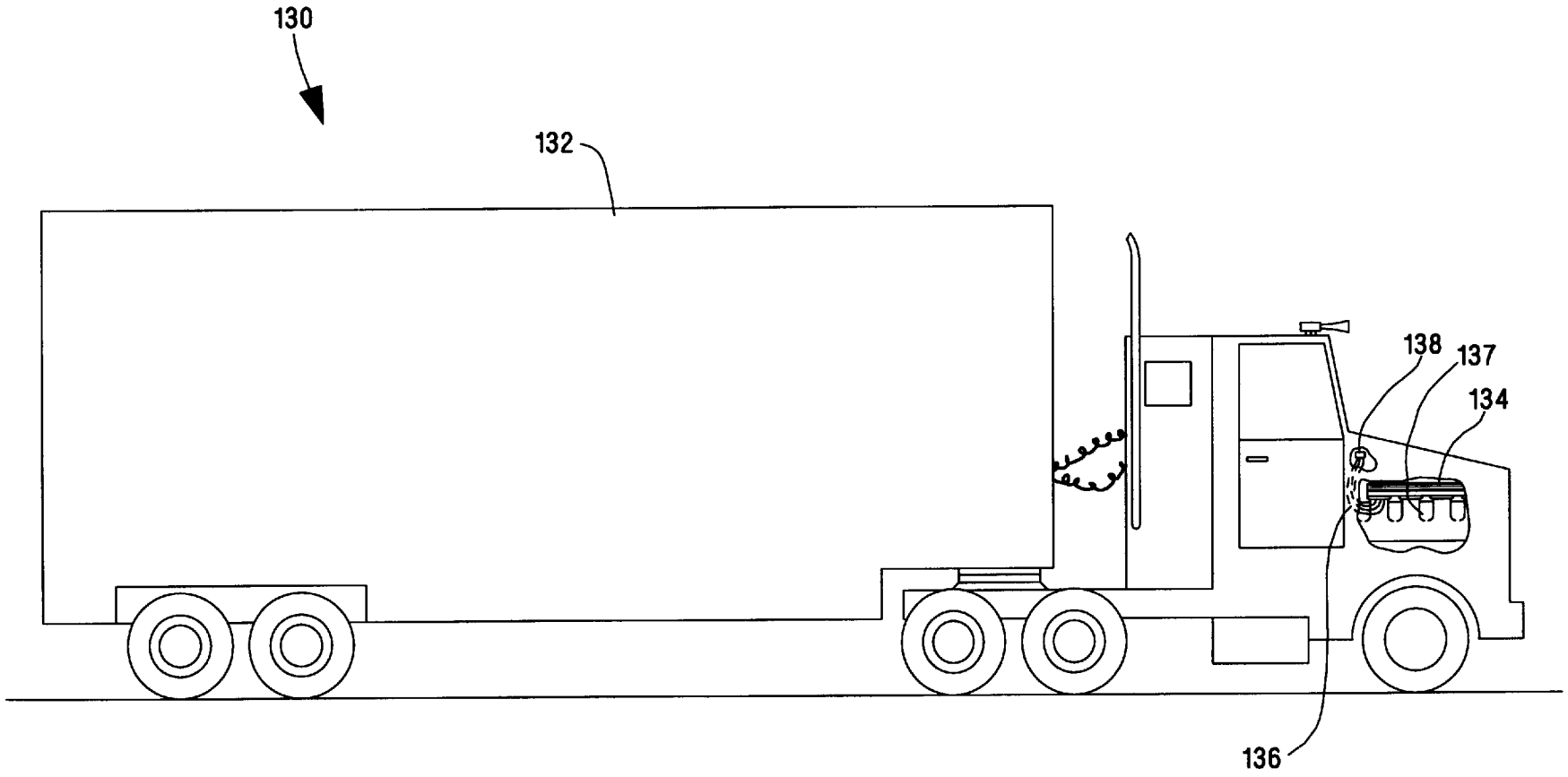

FIG. 10B is an illustration of an overland truck powered by the variable displacement Diesel engine of the invention.

Figure 11:
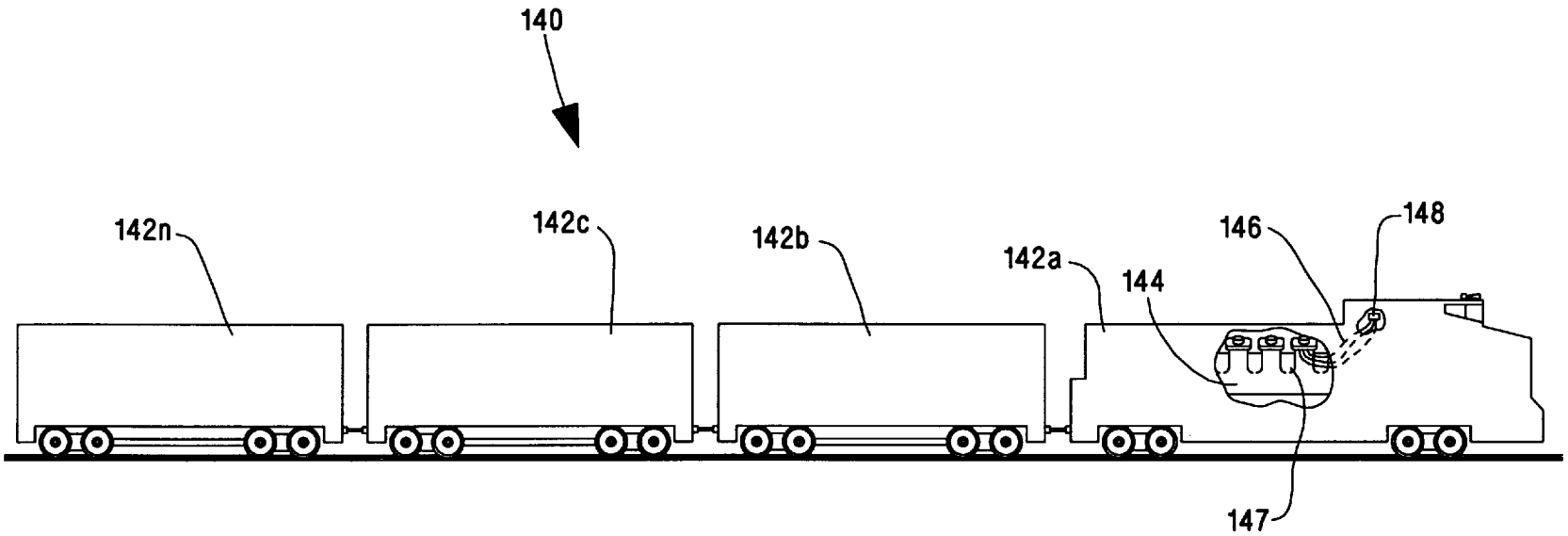

FIG. 11 is an illustration of a railway locomotive powered by the variable displacement Diesel engine of the invention.

Figure 12:
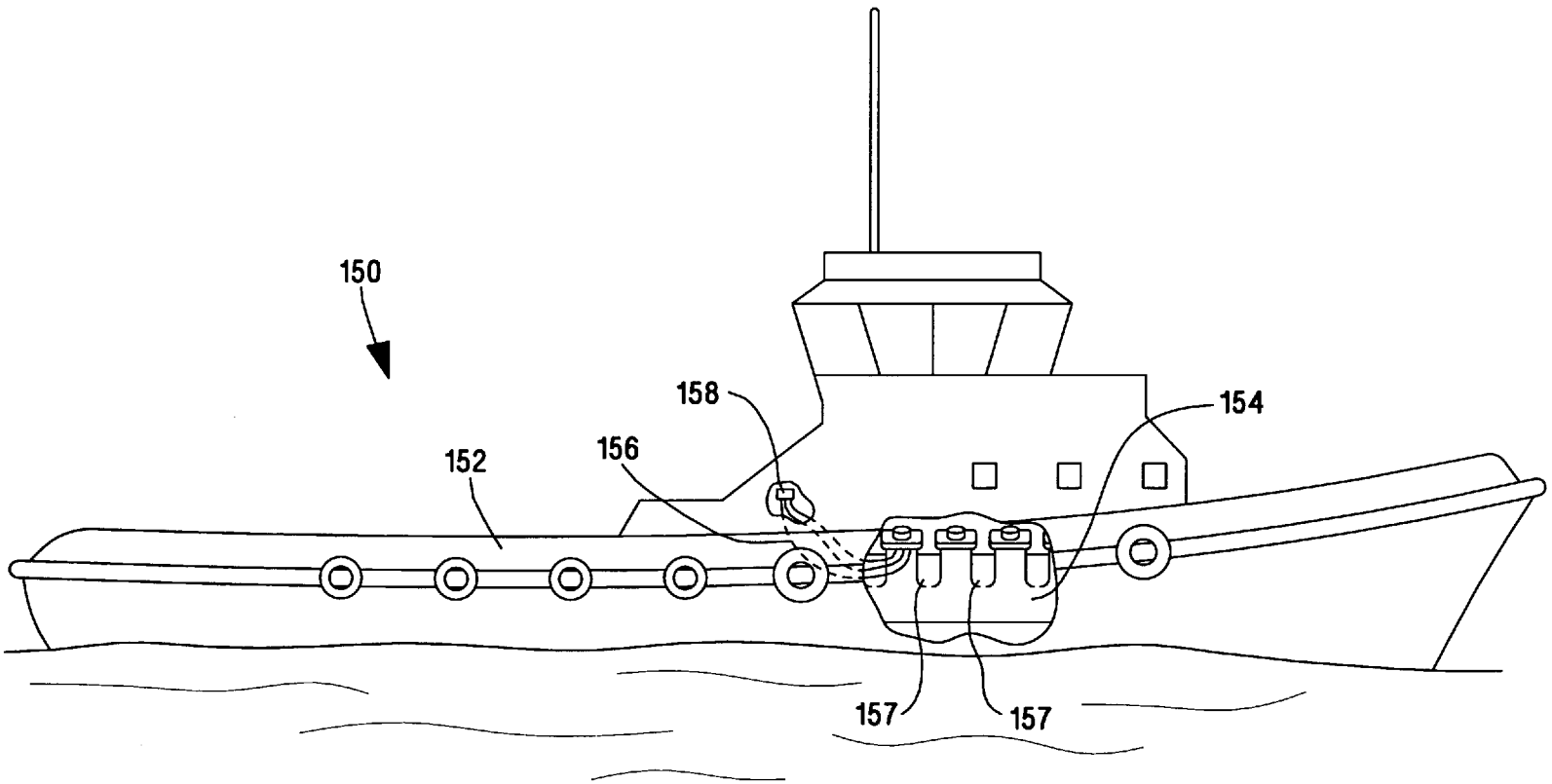

FIG. 12 is an illustration of a marine tug boat powered by the variable displacement Diesel engine of the invention.

DESCRIPTION OF PREFERRED EMBODIMENTS

In accordance with one embodiment of the present invention, an automotive diesel engine is provided with means for de-activating one or more cylinders during low load and/or moderate load conditions, and with means for re-activating some or all of the deactivated cylinders under greater or full load.

In accordance with the invention, the number of operative cylinders of an automotive Diesel engine for example, but not limited to a Diesel engine similar to, but not limited to a General Motors 5.7 liter V-8 Diesel engine is reduced under low load, and/or intermediate load operating conditions by not providing Diesel fuel to selected cylinders, under light and/or intermediate load conditions, and then under heavy load conditions, more cylinders, or all cylinders are activated and provided with fuel for combustion.

In accordance with another embodiment of the present invention, prior to restoring fuel to inactive cylinders if the inactive cylinders have become below minimum operating temperature, as determined by a temperature sensor, the computer activates the respective glow plugs of the previously inactive cylinders to heat up the cylinders prior to re-introducing fuel.

As an example, when the engine is subject to low load, such as cruising on relatively flat highway or going down hill, two or four cylinders may be deactivated, preferably four.

If four cylinders are deactivated under moderate load such as encountering a hill with a small incline, then two additional cylinders are activated by the computer as the hill is encountered.

The shut down of selected cylinders under light load and reactivation under moderate and/or heavy load is computer controlled including control of reactivation of the respective glow plugs prior to reintroduction of fuel into the previously deactivated cylinders to insure that the previously inactive cylinders are sufficiently warm for the combustion process.

In accordance with another embodiment of the present invention, means are provided for maintaining closed during deactivation one or both of the inlet and exhaust valves of each cylinder which is deactivated.

In accordance with another embodiment of the invention, the computer controls selection of cylinders to be operated at low and intermediate load, to alternate and/or switch operative cylinders, so that cylinder, piston, plug, valve and other parts wear is generally even, whereby cylinder repair is reduced and maintenance cost is reduced.

In accordance with another embodiment of the present invention, the computer controls cylinder selection during low and intermediate load conditions to select cylinders to be operated whereby the temperature of the inactive cylinders is prevented from becoming sufficiently cool to cause significant stress between cylinders due to contraction and/or expansion of cylinder, piston, plug or other parts in the engine.

In accordance with another embodiment of the invention, in applications where it is not possible to vary the specific cylinders to not be given fuel, the computer reactivates some additional, or all additional cylinders if the temperature of one or more inactive cylinders, or other parts of the engine become sufficiently cool to cause significant stress between cylinders or between other engine parts due to contraction and or expansion of engine parts.

In one specific embodiment of he invention, a General Motors eight cylinder, 5.7 liter Diesel engine is provided with means to deactivate two or four cylinders during periods of light or moderate engine load. As an example, the means to deactivate the cylinders may comprise generally a Modulated Displacement system utilized in the 1981 Cadillac 6.0 liter 4-6-8 gasoline engine, modified to the extent necessary, or desirable to adapt to, and computer control the 5.7 liter General Motors Diesel engine.

Information about the two engines, the Modulated System, and the Computer system are publicly available, for example in the 1981 Cadillac Service Information Manual, including Appended Electrical and Mechanical wiring Diagrams, available from General Motors, Cadillac Motor Division, Detroit Mich. 48232; many Public Libraries, and Haynes Publishing Co. hereby incorporated into the present application by this reference.

The engines are similar in size as to block, bore, stroke and displacement, with the Diesel displacement, slightly smaller.

However, because of the similar engine size, the Modulated Displacement principles and computer control utilized in 6.0 liter V-8 may be utilized in the General Motors 5.7 liter Diesel engine to deactivate four and/or two cylinders with relatively small modifications in principle.

In a preferred embodiment temperature sensors are provided in at least the cylinders to be deactivated, and preferably in all cylinders to monitor the temperature of the deactivated cylinders, and preferably the temperature of the cylinders which remain active.

If the computer senses that the temperature of deactivated cylinders has become lower than the temperature necessary for spontaneous combustion, in one embodiment, the glow plug for that or those cylinders are turned on to enable spontaneous combustion if load conditions change, such as encountering a hill, or a need to accelerate. After proper operating temperature is reached, if the load does not change, the glow plugs are turned off until the temperature again drops below operating temperature range, or an increased load occurs, and the cylinders are again activated.

In accordance with another embodiment of the invention, after the computer turns on the glow plug or plugs of cylinders deactivated, such cylinders are reactivated until the the cylinder temperature again reaches a desired operating temperature, even if the load condition does not increase.

In accordance with another embodiment, temperature sensors for each cylinder are not provided, and the computer senses lowering of temperature in the cooling fluid, and activates glow plugs of deactivated cuylinders after a predetermined temperature drop and optionally reactivates such deactivated cylinders even if load conditions do not increase.

While the later embodiment, which does not require adding additional sensors is less expensive, it does not provide for as accurate control of cylinder temperature and optimum conditions for spontaneous combustion of previously deactivated cylinders.

As described on pages 6A–37A of the 1981 Cadillac Service information Manual the MD system senses Engine Revolutions per minute, Coolant Temperature, Throttle Position, and Absolute Pressure in the Intake Manifold.

In accordance with one or more previous embodiments the MD system is modified to sense and process in a computer engine control system other variables including, but not limited to, indivigual cylinder temperature, and the presence or absence of the operation of the glow plugs for given cylinders.

Information obtained from sensors is sent to a suitable electronic computer processing unit (ECP) containing one or more computer programs to assimilate and process the data obtained from the sensors. The ECP processes the data and determines the number of operating cylinders required for he given load condition.

In accordance with one embodiment, four valve selectors are utilized to deactivate either four or two cylinders to enable the engine to operate on either four or six cylinders, after start up on eight cylinders, and operation on eight cylinders on heavy load condiions.

In another embodiment four valve selectors are used to deactivate four cylinders, and operation of four cylinders occurs on low or moderate load conditions, and eight cylinder operation occurs on start up and heavy load conditions. While this embodiment causes somewhat more operation on eight cylinders, and a small increase in fuel consumption, under both four and eight cylinder operation, the engine loads are relatively balanced and engine vibration is reduced as compared to 4-6-8 operation when some engine vibration occurs in the six cylinder operation mode.

In one embodiment, valve selectors are installed on cylinders 1,4, 6 and 7. In the four cylinder mode, cylinders 1, 4, 6 and 7 are deactivated. In the six cylinder mode, only cylinders 1 and 4 are deactivated.

Figure 1:
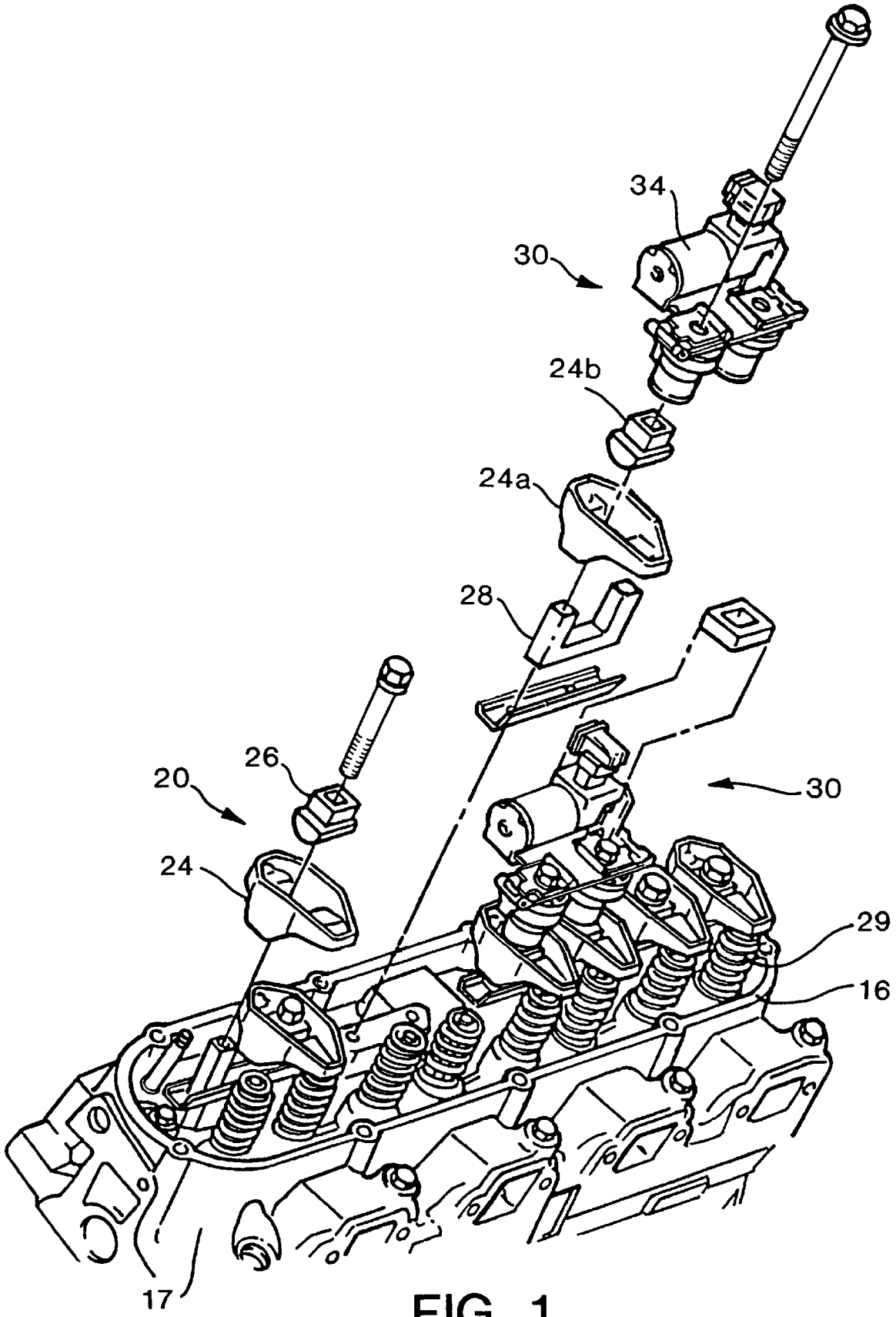
FIG. 1 is a schematic perspecive view of one embodiment of a "V" type Diesel engine of the present invenion.
Figure 2:
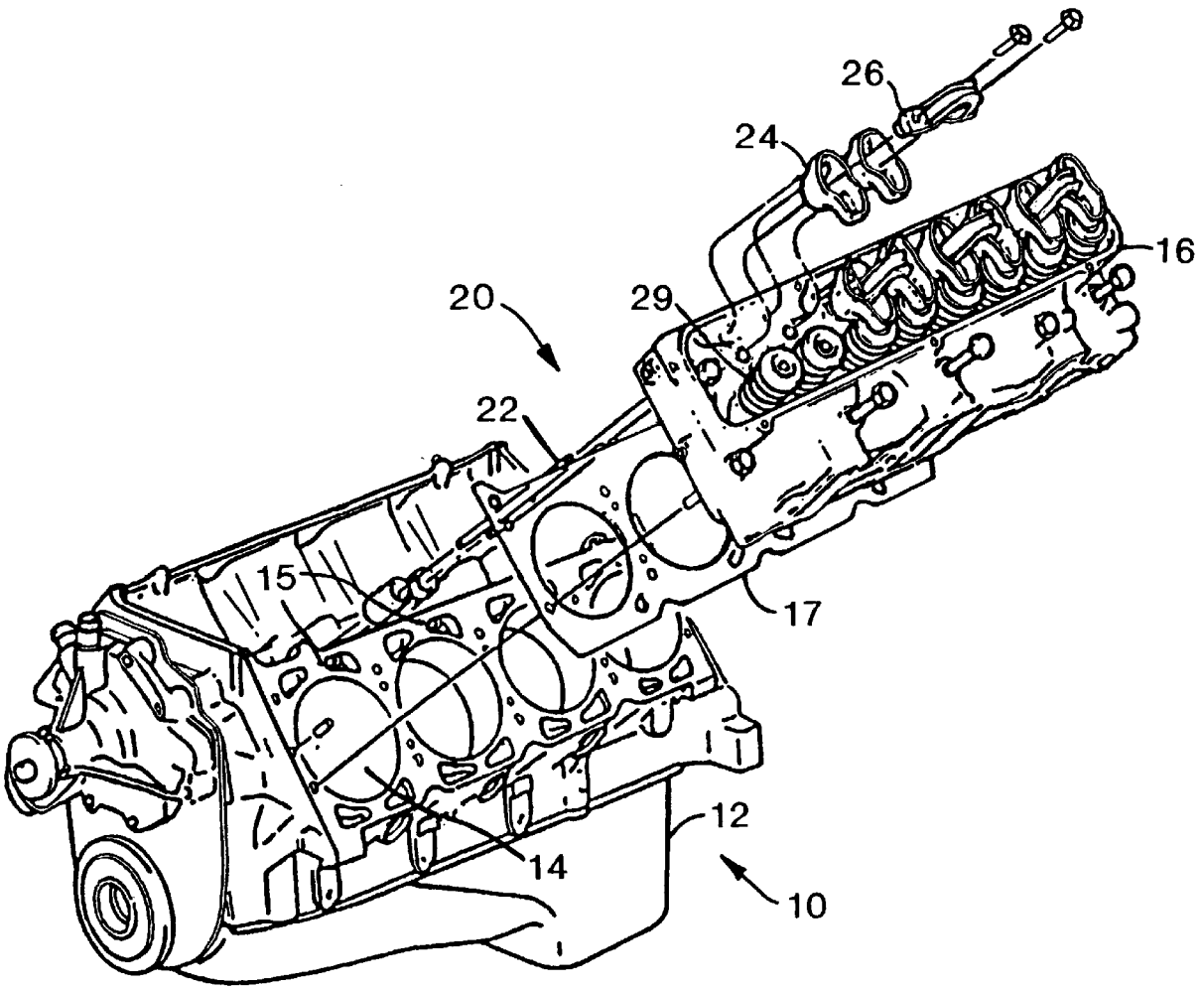
FIG. 2 is a schematic perspective view illustrating the valve assemblies which may be used in the present invention.

In accordance with another embodiment of the present invention, the valve system utilized in the General Motors 4-6-8 gasoline engine is utilized to control the active cylinders in a 5.7 liter diesel engine illustrated in FIGS. 1 and 2.

FIG. 1 illustrates a 5.7 liter diesel engine 10 including a lower block 12 having cylinders therein 14 to receive pistons (not shown). Block 12 receives a head 16 and a gasket 17. Inlet valves 18 and exhaust valves 19 are controlled by a rocker arm assembly 20 including push rods 22, rocker arms 24, a rocker arm pivot 26, bolts 27, a pedestal 28, and springs 29. Temperature sensors are shown at 15.

FIG. 4 is a view illustrating a cam shaft 42, having a cam 44, with a cam lobe 46 which causes movement in the push rod 20 which causes pivotal movement of the rocker arm 24 and opening and closing of the valve 18.

Specifically, as shown in FIG. 3, valve selector assemblies 30 are mounted on the intake and exhaust rocker arms 24 above the rocker arm fulcrum point 26. The valve selector assemblies 30 include a solenoid valve 34 which activates a piston 36 which is connected to a blocking plate 38.

During conventional active operation FIG. 3A, the rocker arm 24 pivots near the center fulcrum point 26, of the rocker arm. As the operative cam 42 reaches it's highest point 46, FIG. 4, the valve 18 is open allowing the fuel and air mixture to enter cylinders 14.

As shown in FIG. 3B, when the solenoid valve 34 is activated, and the piston 36 is moved from the position shown in FIG. 3A left to right to the position illustrated in FIG. 3B, wherein the blocking plate 38 has been moved from the position shown in FIG. 2A to the position shown in FIG. 2B. In this position the pivot point has been moved to the position shown in FIG. 2B at 32, whereby when the cam is again at its high point the valves will not open because the rocker arm does not pivot at the center point 26, but rather at the pivot point 32. This allows the rocker arm to slide up and down on its mounting stud 40.

The valve selector operation is not limited to a V8 engine and may be utilized generally for example in a Diesel V6 engine.

Furthermore, the cam shaft for the Diesel engine may be located above the valves and a valve selector operation utilized as described in detail in U.S. Pat. Nos. 4,546,734, and 4,615,307, hereby incorporated into the present application by this reference.

Moreover, the Diesel engine may be an overland truck engine, a train locomotive engine, a marine Diesel engine for ships and/or barges, or a Diesel engine for industrial power plant applications, including, but not limited to heating and air conditioning of office buildings or plants.

For many applications the computer is programmed not to activate the valve selector operation until a high or overdrive gear is reached by the transmission. For heavy load applications all cylinders should be activated in low gears.

The number of cylinders to be deactivated will vary with the type of engine. For example, six cylinder in line-overland truck engines may deactivate either three or preferably two cylinders at light load. V-8, V-12, and V-16 engines will be programmed to deactivate more cylinders in light or even moderate load applications. Proper computer programming and control is necessary to achieve successful operation.

The particular valve selector arrangement will also vary with the application. For appropriately sized V type engines, selectors of the type used by General Motors in the 4-6-8 gasoline engine may be used. For other applications dimensions and load carrying members in the selector assemblies may be modified to meet particular applications. Moreover the particular valve selector design will depend upon dimensions of the engine, loads to be encountered, and projected life before overhaul.

As an example, the Cummins M11 (brochure attached and hereby incorporated into this application by this reference) is a computer controlled six cylinder engine which could readily be provided with valve selectors, and the computer programs modified to achieve valve selector operation, and operation, and even greater fuel economy, and perhaps less wear and longer life between overhauls.

FIG. 5 illustrates an in-line six cylinder M11 computer controlled Cummins Diesel engine 50 including a high strength cylinder block 52 having cylinders 54 having cylinder liners 56 receiving pistons 58 with rings 60 having ring inserts 62. The pistons 58 are connected to connecting rods 64 which are in-turn connected to an induction hardened crank shaft 66. A gear train 68 drives a cam shaft 70 having lobes 72 which control movement of push rods 74 which pivot rocker arms 76 to move valve stem 78 and open and close valves 80.

Two or more valve selectors 82 constructed in the same manner as valve selector 30 including a solenoid valve 84, a piston 86 and a blocking plate 88, appropriately dimensioned for the M11 engine are then installed to deactivate two or three cylinders under low or moderate load conditions when the transmission is in high and/or overdrive gear under the control of the CELECT Plus computer 90 whose program 92 is modified to include a deactivation-activation program 94 to control deactivation and activation of selected cylinders 54, and control operation of glow plugs.

Alternatively the valve selector operation described in U.S.. Pat. Nos. 4,546,734 and/or 4,615,307 may be utilized under the control of computer 90 and a deactivation-activation program 94' may be used.

FIG. 6 illustrates a computer 7 controlling cylinders 1, 2, 3 in an N cylinder Diesel engine with the sensors 1s, 2s, 3s, glow plugs 1GP, 2GP, and 3GP, injectors 1I, 2I, 3I, intake valves 1Vi, 2Vi, 3Vi, exhaust valves 1ve, 2ve, 3ve, and valve actuators/deativators 1Va, 2Va, 3Va, for all cylinders. The computer 7 receives the cylinder temperatures from Sensors 1s, 2s, 3s, the Load L from a load sensor Ls, data from other Sensors Sx, Sy, and computes which cylinders should be deactivated and activated, when the glow plugs of various cylinders are to activated prior to activating cylinders, and sends electrival signals to to the Valve Actuator/Deactivators 1Va, 2Va, 3Va, Glow Plugs 1GP, 2GP, 3Gp, and fuel injectors 1I, 2I, 3I to activate and deactivate various cylinders, depending on the load, the temperature of the indivigual cylinders, and other commonly computer controlled variables.

The computer as an example may be the Electronic Diesel Control (EDC) processing unit described in DIESEL FUEL INJECTION, Bosh, 1994 EREF TJ 797 D55, pp 186–191.

The control of the various cylinders is monitored and controlled in a manner illustrated in FIGS. 7 and 8. FIGS. 7 and 8 illustrates a Summary of the Computer Glow Plug and Cylinder Activation Sequence used by the computer in controlling activation and deactivation of cylinders and glow plugs during operation. A sample Computer Program is found in the Application Appendix in Psuedo code.

The program 500 includes a first step 502 of turning on the engine which is activated by the ignition key and includes the Step of activating the program 600 in FIG. 8 which activates the glow-plugs for all cylinders and heating up all cylinders prior to ignition. At Step 504 when minimum operating temperature is in each cylinder the starter motor for the engine is turned on at step 506.

At Step 508 the program obtains the temperature and loads for all cylinders. In some embodiments it may be activated by reaching a selected transmission gear such as after the engine reaches high gear for an automotive embodiment.

At Step 510, if any cylinders are below a minimum operating temperature the cylinder flags for operating the glow plugs in the program 600 in FIG. 8 are activated.

At Step 512 the program determines whether the load L is less than a selected load L1. If the load is less than L1 at Step 514 this program calls the program 600 to activate glow plugs to warm up any cold cylinders.

At Step 516 cylinders are deactivated and remain deactivated until the load exceeds L1.

If the answer to the load evaluation Step 512 is negative at Step 518 the Program determines if the load is less than a larger load L2. If the answer is affirmation at Step 520, cylinders are deactivated which are not needed for medium loading. After cylinders have been deactivated at 520, Step 522 calls program 600 to warm up any cold cylinders. If the answer, to the question at Step 5-18 is negative, in step 5-24 it is determined whether or not 6 cylinders are running with the start cylinder program 600.

At Step 5-26, the program asks if the load is greater than load L3. If the answer is affirmative, then additional cylinders are turned on with the program at 600.

It is to be noted hat if the load is less than L1 at Step 512 and, for example, only 4 cylinders are operated, nonetheless at 5-14 the program calls the start cylinder program 600 to be certain that all cylinders are at a minimum operating temperature and, if they are not, they are warmed up in accordance with program 600. The same applies to a situation where the load is less than L2, but a time period has elapsed and it is necessary to check at Step 520 to make sure that deactivated cylinders are nonetheless at a minimum temperature to avoid thermal stress of the engine.

In program 600 in the first step, 602, the program orders that the temperature for a given cylinder be read at 604. At step 606 if the temperature of the cylinder is less than a predetermined temperature T1 then at Step 608 the glow plug for that cylinder is activated. If the answer to the question at Step 606 is in the affirmative, the cylinder is activated at Step 610.

At Step 612 if the cylinder temperature was initially below T1 so that the glow plug was activated at step 608, at Step 612 the cylinder will be required to operate for at least 10 minutes to warm-up the cylinder to avoid thermal stress in the engine.

After these steps are taken this Program for a given cylinder is deactivated at Step 614, and the same Steps are taken for another cylinder, until all cylinders are so processed. It is thus to be understood that the program 600 continuously operates for each of the cylinders in the engine.

FIG. 9 illustrates an automobile embodiment 120 in which an automobile 122 is powered by a Variable Displacement Diesel Engine of the present invention 124 having electrical wires 126 connecting the engine cylinders 127 to a computer 128 for controlling the operation, activation and deactivation of the cylinders in accordance with the present invention.

FIGS. 10 and 10A illustrate a building 100 having floors 102 which may be used for manufacturing and/or office work such as administration. The building 100 including floors 102 is heated and cooled during the seasons of the year by a variable displacement Diesel engine 104 constructed and operated according to the principles of the present invention which drives a load comprising a heating and air conditioning unit 106 by means of shaft 108.

During evenings, weekends, and holidays the load experienced by unit 106 may be significantly reduced, allowing deactivation of cylinders in the Diesel engine 104 in accordance with the present invention by computer 109.

FIG. 10B illustrates an overland truck embodiment in which an overland truck 130 having a trailer 132 is powered by a variable Displacement Diesel Engine of the present invention 134 having electrical wires 136 connecting the engine cylinders 137 to a computer 138 for controlling the operation, activation and deactivation of the cylinders in accordance with the present invention.

FIG. 11 illustrates a train-locomotive embodiment in which a train 140 having a locomotive 142*a* and cars 142*b*, 142*c*, 142*n*, is powered by a Variable Displacement Diesel Engine of the present invention 144 having electrical wires 146 connecting the engine cylinders 147 to a computer 148 for controlling the operation, activation and deactivation of the cylinders in accordance with the present invention FIG. 12 illustrates a marine embodiment in which a tug boat 150 having a cargo deck 152 is powered by a variable Displacement Diesel Engine of the present invention 154 having electrical wires 156 connecting the engine cylinders 157 to a computer 158 for controlling the operation, activation and deactivation of the cylinders in accordance with the present invention.

What is claimed is:

1. In a method of operating a variable displacement Diesel engine including:

providing a Diesel engine having a plurality of cylinders with pistons movable within said cylinders; said pistons connected to a crank shaft; said cylinders at least partially defining combustion chambers in said engine; supplying Diesel fuel to said combustion chambers;

activating glow plugs for heating said combustion chambers to minimum operating temperature; operating valve means for introducing air and fuel for combustion into said combustion chambers, and for allowing combustion gasses to exist from said combustion chamber; applying a load to said crank shaft;

the improvement comprising: under computer control reducing the number of operative cylinders under reduced load operating conditions including discontinuing the supply of fuel to selected cylinders; and under increased load conditions, computer controlled activating additional cylinders, including providing said deactivated cylinders with fuel for combustion; and computer controlled activating the respective glow plugs of the previously inactive cylinders if the temperature of said inactive cylinders has become below a minimum operating temperature, to heat up the deactivated cylinders and then re-introducing fuel into said deactivated cylinders.

2. A method of operating a variable displacement Diesel engine according to claim 1 including controlling the shut down of selected cylinders under light and/or intermediate load and reactivation under heavy load by computer and computer controlling reactivation of the respective glow plugs prior to reintroduction of fuel into the previously deactivated cylinders.

3. A method of operating a variable displacement engine according to claim 1 including controlling by computer selection of cylinders to be operated at low and intermediate load, and selection of cylinders to alternate and switch.

4. A method according to claim 3 wherein the engine powers an automobile.

5. A method according to claim 3 wherein the engine powers an overland truck.

6. A method according to claim 3 wherein the engine powers a railway locomotive.

7. A method according to claim 3 wherein the engine powers a marine.

8. A method according to claim 3 wherein the engine powers an industrial plant.

9. A method according to claim 3 wherein the engine powers heat and air conditioning equipment.

10. A method of operating a variable displacement engine according to claim 3 including sensing the temperature of cylinders and computer controlling cylinder selection during reduced load conditions to select cylinders to be operated whereby the temperature of inactive cylinders is prevented from becoming sufficiently cool to cause excessive stress between cylinders.

11. A method of operating a variable displacement engine according to claim 3 including sensing the temperature of cylinders and other parts of the engine; reactivating by computer additional cylinders if the temperature of at least one inactive cylinder, or other parts of the engine, become sufficiently cool to cause excessive stress between cylinders or between engine parts due to contraction and/or expansion of engine parts.

12. In a Diesel engine including an engine block having a plurality of cylinders with pistons movable within said cylinders; said pistons connected to a crank shaft; said cylinders at least partially defining combustion chambers in said engine; means for supplying Diesel fuel to said combustion chamber; glow plugs for heating said combustion chambers to minimum operating temperature; valve means for introducing air and fuel for combustion into said combustion chamber and for allowing combustion gasses to exist from said combustion chamber; means for applying a variable load to said crank shaft;

the improvement comprising: computer controlled means for reducing the number of operative cylinders under reduced load operating conditions including means for discontinuing the suppley of fuel to selected cylinders under reduced load conditions; and under increased load conditions computer controlled means for activating additional cylinders including means for supplying deactivated cylinders with fuel for combustion, and computer controlled means for activating the respective glow plugs of the previously inactive cylinders if the previously inactive cylinders have become below a minimum operating temperature, to heat up the deactivated cylinders and then re-introducing fuel to said deactivated cylinders.

13. A variable displacement engine according to claim 12 wherein the computer controls selection of cylinders to be operated at low and intermediate load, to alternate and switch operative cylinders.

14. A variable displacement engine according to claim 13 including temperature sensor means connected to said computer and wherein the computer controls cylinder selection during reduced load conditions to select cylinders to be operated whereby the temperature of inactive cylinders is prevented from becoming sufficiently cool to cause significant stress between cylinders.

15. A variable displacement engine according to claim 14 including temperature sensing means connected to said computer and wherein the computer reactivates additional cylinders if the temperature of one or more inactive cylinders, or other parts of the engine become sufficiently cool to cause significant stress between cylinders or between engine parts due to contraction or expansion of engine parts.

16. A variable displacement Diesel engine according to claim 14 wherein temperature sensing means are provided in the engine which are read by said computer to control activation and deactivation of cylinders.

17. A variable displacement Diesel engine according to claim 16 wherein the Diesel engine is provided with a cooling system for cooling the cylinders in the engine and a fluid exit counduit is connected to the last cylinder cooled by the system and wherein temperature sensing means are provided in the coolant fluid exit conduit after the last cooled cylinder of the engine.

18. A variable displacement Diesel engine according to claim 17 wherein the Diesel engine is provided with a cooling system for cooling the cylinders in the engine and a fluid entrance counduit is connected to the first cylinder cooled by the system and wherein temperature sensing means are provided in the coolant fluid entrance conduit before the first cooled cylinder of the engine.

19. A variable displacement Diesel engine according to claim 16 wherein temperature sensing means are provided in the the cylinder wall of each cylinder in the engine.

20. A variable displacement Diesel engine according to claim 16 wherein temperature sensing means are provided in each cylinder in the engine adjacent the combustion chamber for that cylinder.

21. A variable displacement Diesel engine according to claim 12 wherein the Diesel engine is a V type Diesel engine.

22. A variable displacement Diesel engine according to claim 21 wherein the Diesel engine is an automotive Diesel engine.

23. A variable displacement Diesel engine according to claim 22 wherein the Diesel engine is a 5.7 liter V-8 Diesel engine.

24. A variable displacement Diesel engine according to claim 12 wherein the Diesel engine is an in-line type Diesel engine.

25. A variable displacement Diesel engine according to claim 12 wherein said Diesel engine powers an overland truck engine.

26. A variable displacement Diesel engine according to claim 12 wherein said Diesel engine powers a railway locomotive engine.

27. A variable displacement Diesel engine accoding to claim 12 wherein said Diesel engine powers a marine Diesel engine.

28. A variable displacement Diesel engine according to claim 12 wherein said Diesel engine powers an industrial plant Diesel engine.

29. A variable Displacement Diesel engine according to claim 28 wherein said Diesel engine powers heat and air conditioning equipment.

* * * * *